US010396484B2

(12) United States Patent
Chen

(10) Patent No.: US 10,396,484 B2
(45) Date of Patent: Aug. 27, 2019

(54) ELECTRICAL CONNECTOR HAVING INTERCONNECTED POWER CONTACT AND ADJACENT HOLDING MEMBER

(71) Applicant: FOXCONN INTERCONNECT TECHNOLOGY LIMITED, Grand Cayman (KY)

(72) Inventor: Ming-Ching Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/003,444

(22) Filed: Jun. 8, 2018

(65) Prior Publication Data

US 2018/0358729 A1 Dec. 13, 2018

(30) Foreign Application Priority Data

Jun. 8, 2017 (CN) ..... 2017 2 0663926 U

(51) Int. Cl.
*H01R 12/71* (2011.01)
*H01R 13/20* (2006.01)

(52) U.S. Cl.
CPC ..... *H01R 13/20* (2013.01); *H01R 12/716* (2013.01)

(58) Field of Classification Search
CPC ..... H01R 23/725; H01R 9/096; H01R 13/20; H01R 12/716
USPC ..... 439/74
See application file for complete search history.

(56) References Cited

U.S. PATENT DOCUMENTS

| | | | | |
|---|---|---|---|---|
| 7,901,218 | B2 | 3/2011 | Sato et al. | |
| 8,845,339 | B2 * | 9/2014 | Ono | H01R 12/7052 439/74 |
| 8,961,215 | B2 * | 2/2015 | Hasegawa | H01R 9/091 439/346 |
| 9,331,410 | B2 | 5/2016 | Obikane et al. | |
| 9,356,371 | B2 | 5/2016 | Goto et al. | |
| 9,362,637 | B2 | 6/2016 | Hasegawa | |
| 9,666,963 | B2 | 5/2017 | He et al. | |
| 9,997,852 | B2 * | 6/2018 | Chen | H01R 12/7017 |
| 2014/0256195 | A1 * | 9/2014 | Obikane | H01R 13/02 439/700 |
| 2016/0013573 | A1 | 1/2016 | Miyazaki et al. | |
| 2016/0315430 | A1 * | 10/2016 | Takeuchi | H01R 12/707 |

(Continued)

FOREIGN PATENT DOCUMENTS

| | | |
|---|---|---|
| CN | 205646309 U | 10/2016 |
| CN | 205646310 | 10/2016 |

*Primary Examiner* — Gary F Paumen
(74) *Attorney, Agent, or Firm* — Wei Te Chung; Ming Chieh Chang

(57) ABSTRACT

An electrical connector includes: an insulative housing defining a receiving space; plural signal contacts secured to the insulative housing and exposed to the receiving space; a pair of holding members secured to two opposite ends of the insulative housing and exposed to the receiving space, each holding member having a base and a pair of arms bent from the base; and plural power contacts secured to the insulative housing, exposed to the receiving space, and disposed adjacent to the pair of holding members, wherein the pair of holding members act as power contacts, and the pair of arms of each holding member are integrally connected to adjacent power contacts.

20 Claims, 12 Drawing Sheets

(56) References Cited

U.S. PATENT DOCUMENTS

| | | | |
|---|---|---|---|
| 2017/0271813 | A1 | 9/2017 | Ge et al. |
| 2018/0076549 | A1 | 3/2018 | Chen |

* cited by examiner

ELECTRICAL CONNECTOR HAVING INTERCONNECTED POWER CONTACT AND ADJACENT HOLDING MEMBER

BACKGROUND OF THE INVENTION

1. Field of the Invention

The present invention relates to an electrical connector having power contacts and holding members also acting as power contacts and more particularly to a structure of adjacent power contacts and holding members that are interconnected to decrease temperature rise in conducting large current.

2. Description of Related Art

U.S. Pat. No. 7,901,218 discloses an electrical connector including first and second fixtures each having at least three engaging or anchoring portions, respectively, that are engaged and therefore caused to be in electrical continuity, thereby using as power supply terminal.

U.S. Pat. No. 9,356,371 discloses a connector including wide terminals that can be connected to power lines and narrow terminals that can be connected to signal lines. The wide terminals are present on both sides of connector housing in longitudinal direction, heat is readily dissipated and does not build up inside the connector.

It is also known to provide an electrical connector of the above board-to-board type that has separate power contacts and holding members with the latter also acting as power contacts. The holding members are located at two opposite ends of an insulative housing of the connector and each may be a one-piece element or made of two parts.

SUMMARY OF THE INVENTION

An electrical connector comprises: an insulative housing defining a receiving space; a plurality of signal contacts secured to the insulative housing and exposed to the receiving space; a pair of holding members secured to two opposite ends of the insulative housing and exposed to the receiving space, each holding member having a base and a pair of arms bent from the base; and a plurality of power contacts secured to the insulative housing, exposed to the receiving space, and disposed adjacent to the pair of holding members, wherein the pair of holding members act as power contacts, and the pair of arms of each holding member are integrally connected to adjacent power contacts.

DETAILED DESCRIPTION OF THE PREFERRED EMBODIMENT

Figure 1:
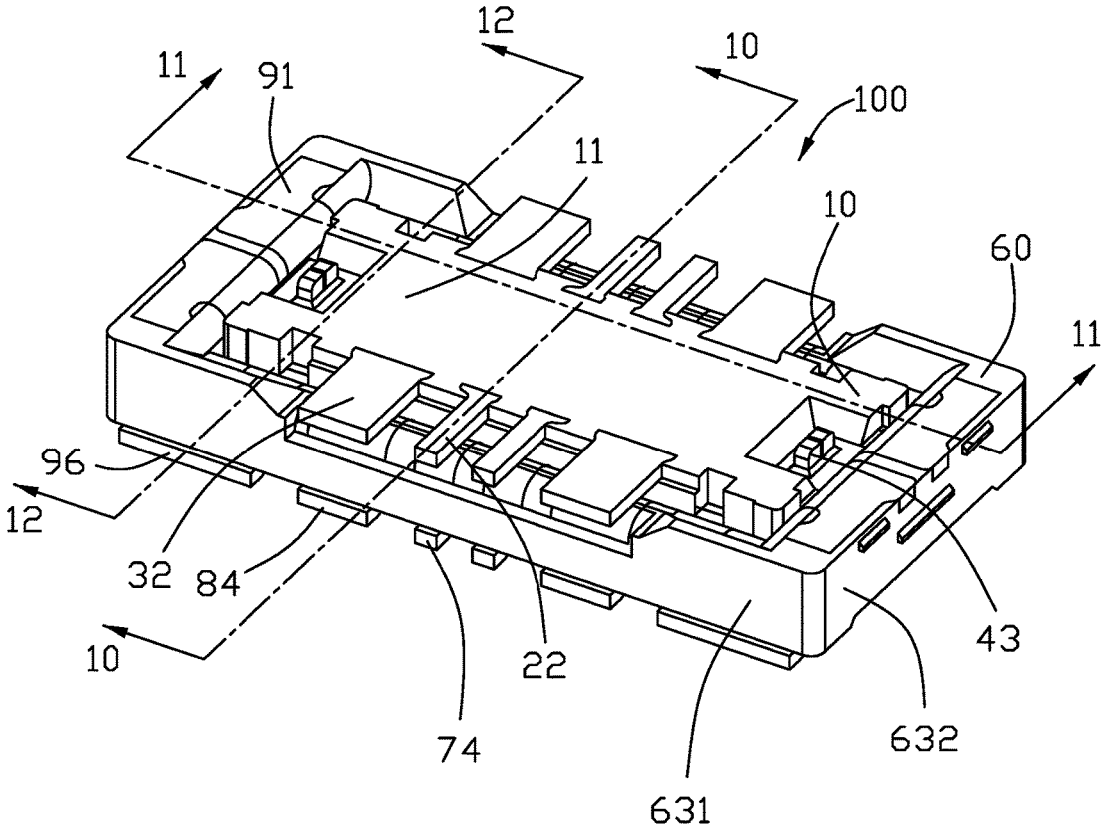
FIG. 1 is a perspective view of an electrical connector assembly in accordance with the present invention.
Figure 2:
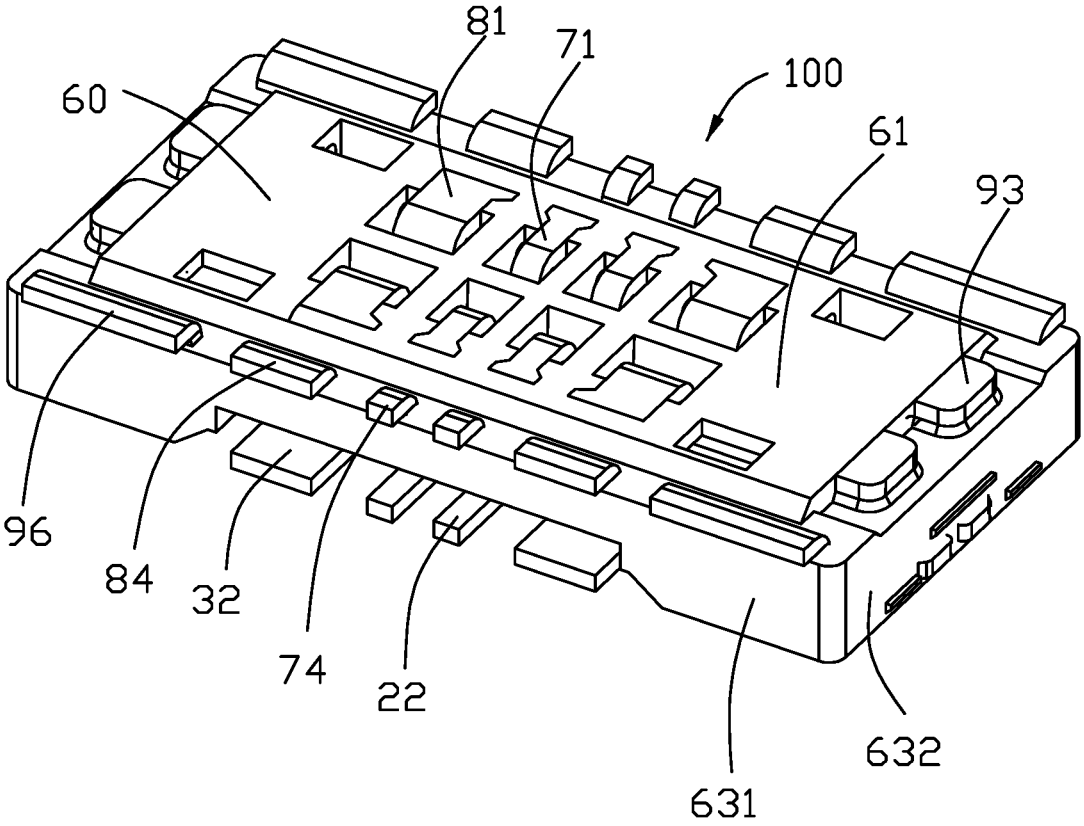
FIG. 2 is another perspective view of the electrical connector assembly.
Figure 3:
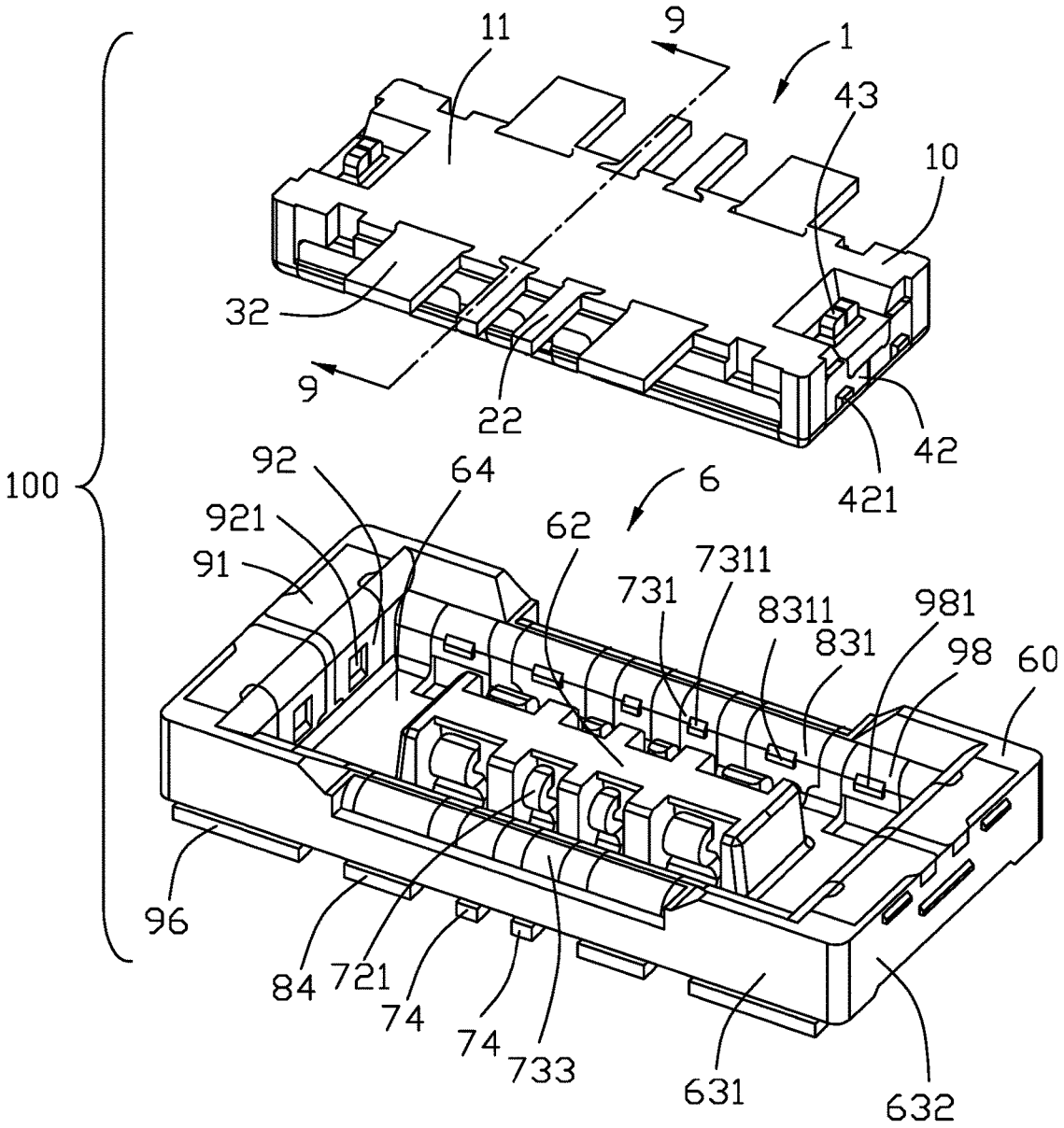
FIG. 3 is a perspective view of a plug connector and a receptacle connector of the electrical connector assembly.
Figure 4:
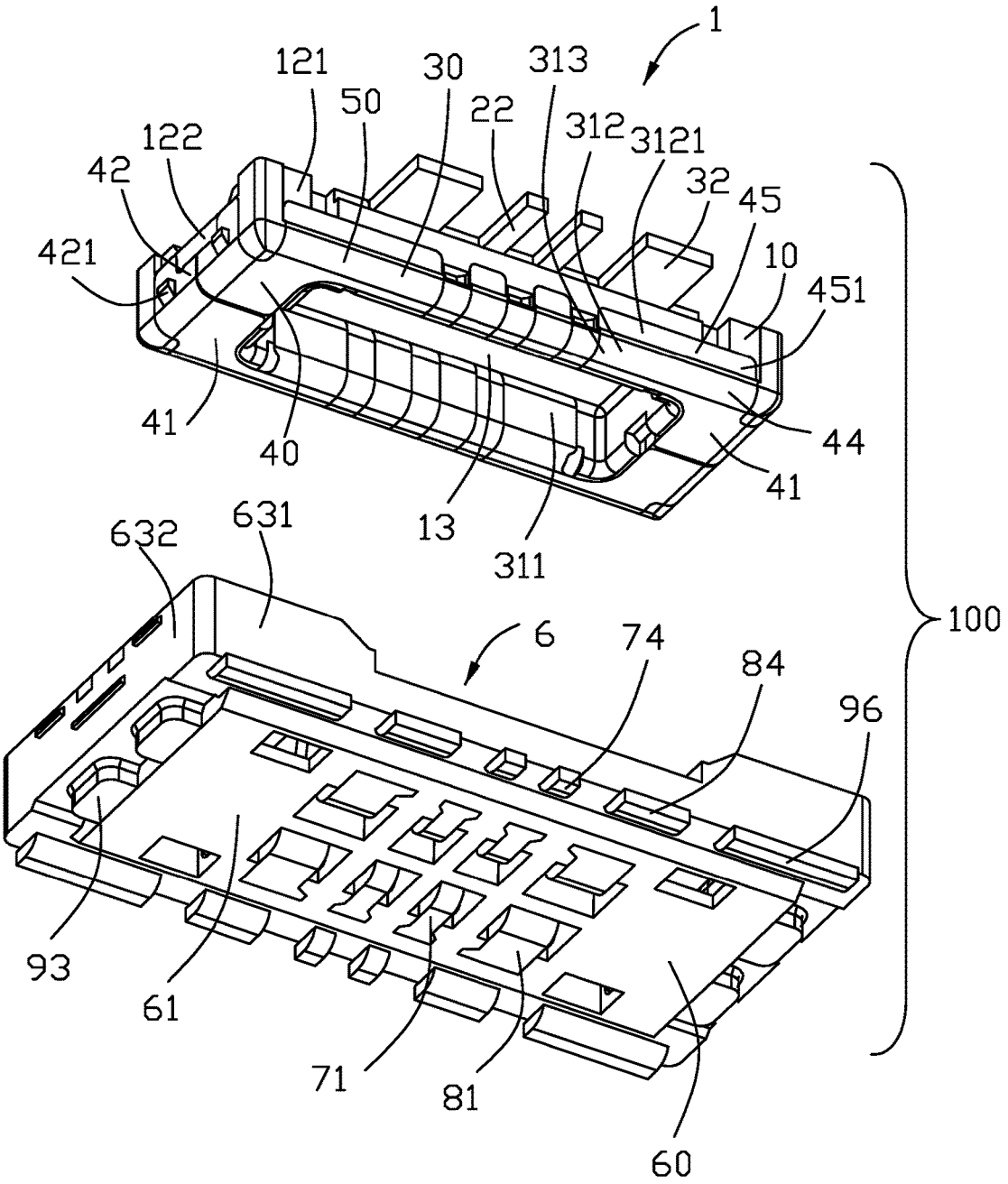
FIG. 4 is another perspective view of the plug connector and the receptacle connector.

Referring to FIGS. 1-4, an electrical connector assembly 100 includes a plug connector 1 and a mating receptacle connector 6.

Figure 5:
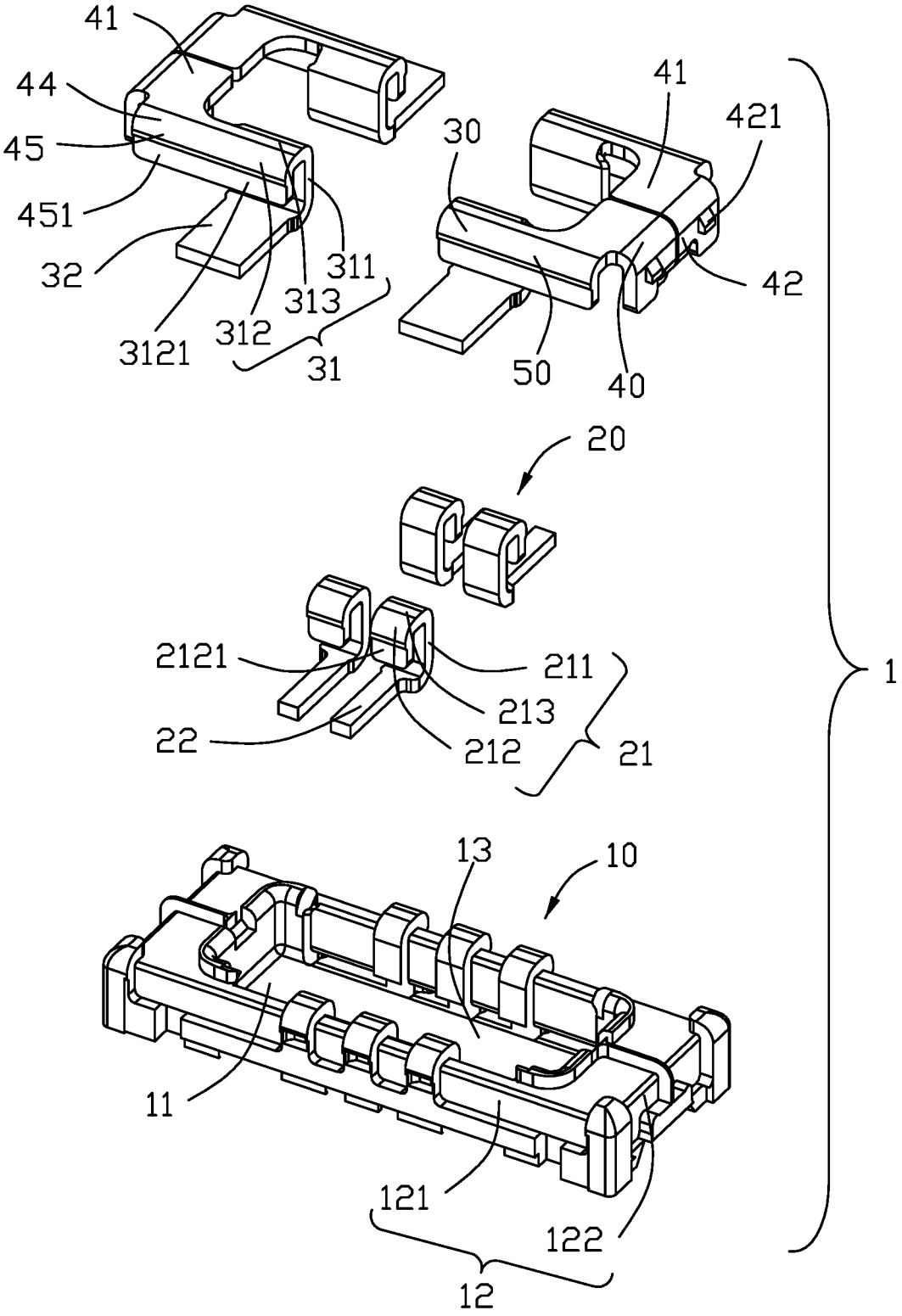
FIG. 5 is an exploded view of the plug connector.
Figure 6:
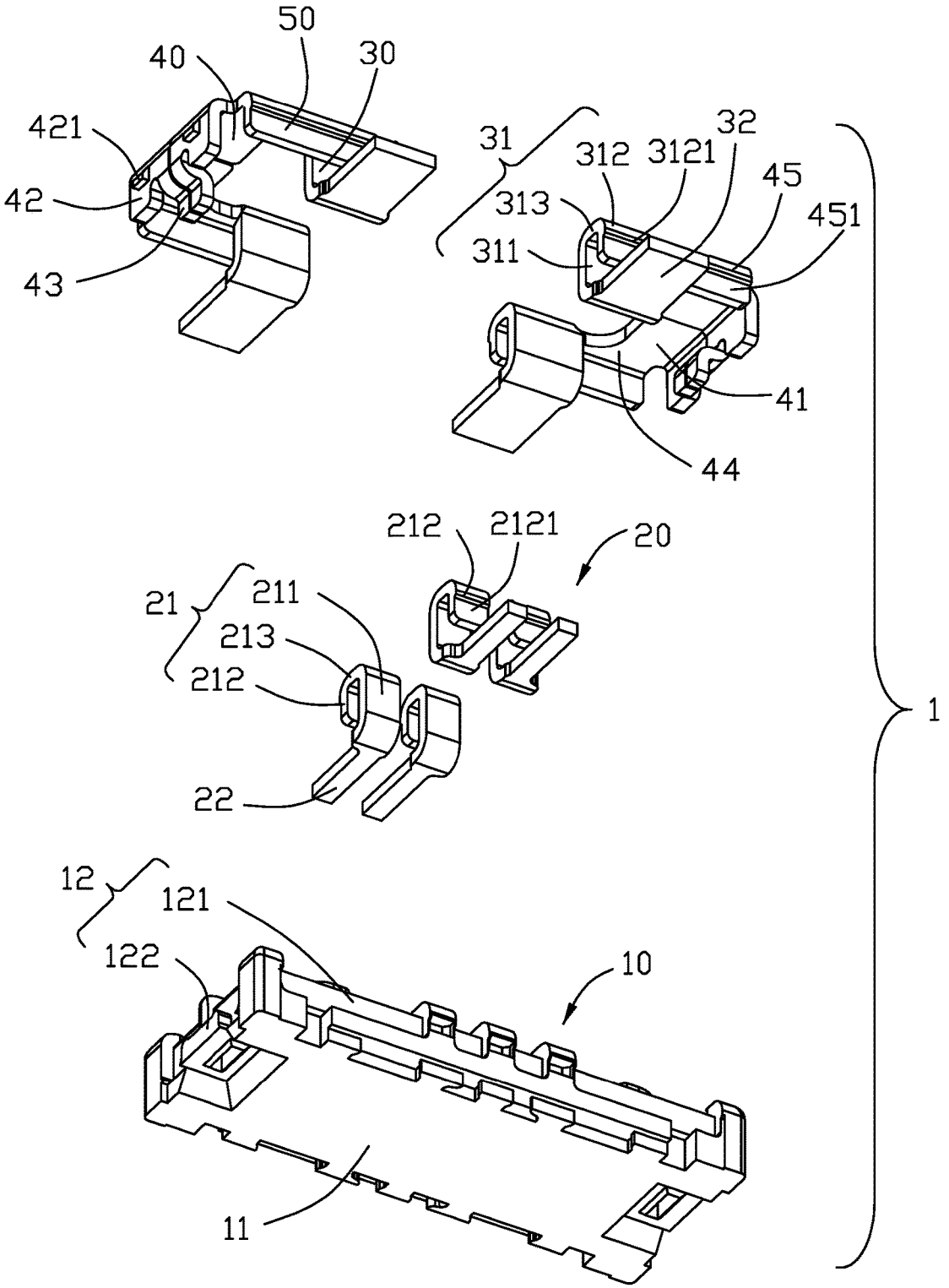
FIG. 6 is another exploded view of the plug connector.

Referring to FIGS. 1-6, the plug connector 1 includes an elongate insulative housing 10, a plurality of signal contacts 20 and a pair of power contacts 30 secured (e.g., insert molded) to the insulative housing, and a pair of holding members 40 secured to two opposite ends of the insulative housing, wherein the pair of holding members are connected to the pair of power contacts by a pair of connecting portions 50.

The insulative housing 10 has a bottom wall 11 and a peripheral wall 12. The peripheral wall 12 has a pair of side walls 121 along a lengthwise direction and a pair of end walls 122 along a widthwise direction. The insulative housing 10 therefore defines a receiving space 13.

Each of the signal contacts 20 has a generally U-shaped part 21 and a soldering part 22. The U-shaped part 21 includes an inner portion 211, an outer portion 212, and an upper portion 213. The outer portion 212 has a step 2121. The inner portion 211 is exposed to the receiving space 13 and the outer portion 212 is exposed to an outside.

Each of the pair of power contacts 30 is similarly structured as the sign contact 20 but has a larger width. Therefore, the power contact 30 has a generally U-shaped part 31 and a soldering part 32, wherein the U-shaped part 31 includes an inner portion 311, an outer portion 312, and a connecting portion 313, the outer portion 312 has a step 3121, and the inner portion 311 is exposed to the receiving space 13 and the outer portion 312 is exposed to an outside.

Each holding member 40 includes a pair of horizontal bases 41, a pair of vertical securing portions 42 extending respectively from the corresponding bases 41, a pair of vertical fixing legs 43 extending respectively from the corresponding securing portions 42, a pair of joining portions 44 extending respectively from the corresponding bases 41, and a pair of vertical outer portions 45 extending from the corresponding joining portions 44, respectively. The securing portion 42 has a pair of protrusions 421. The outer portion 45 has a step 451. In this embodiment, the step 451 is continuously connected with the step 3121 of the power contact 30.

Each connecting portion 50 is integrally connected between the joining and outer portions 44 and 45 of the holding member 40 and the upper and outer portions 313 and 312 of the power contact 30. In the embodiment shown each holding member 40 is made of two parts, though it may be a one-piece construction if desired and properly configured and dimensioned. Notably, in this embodiment, each holding member is required to be made of two parts because of existent soldering part 32 extending from the inner portion 311 of each power contact 30.

Figure 7:
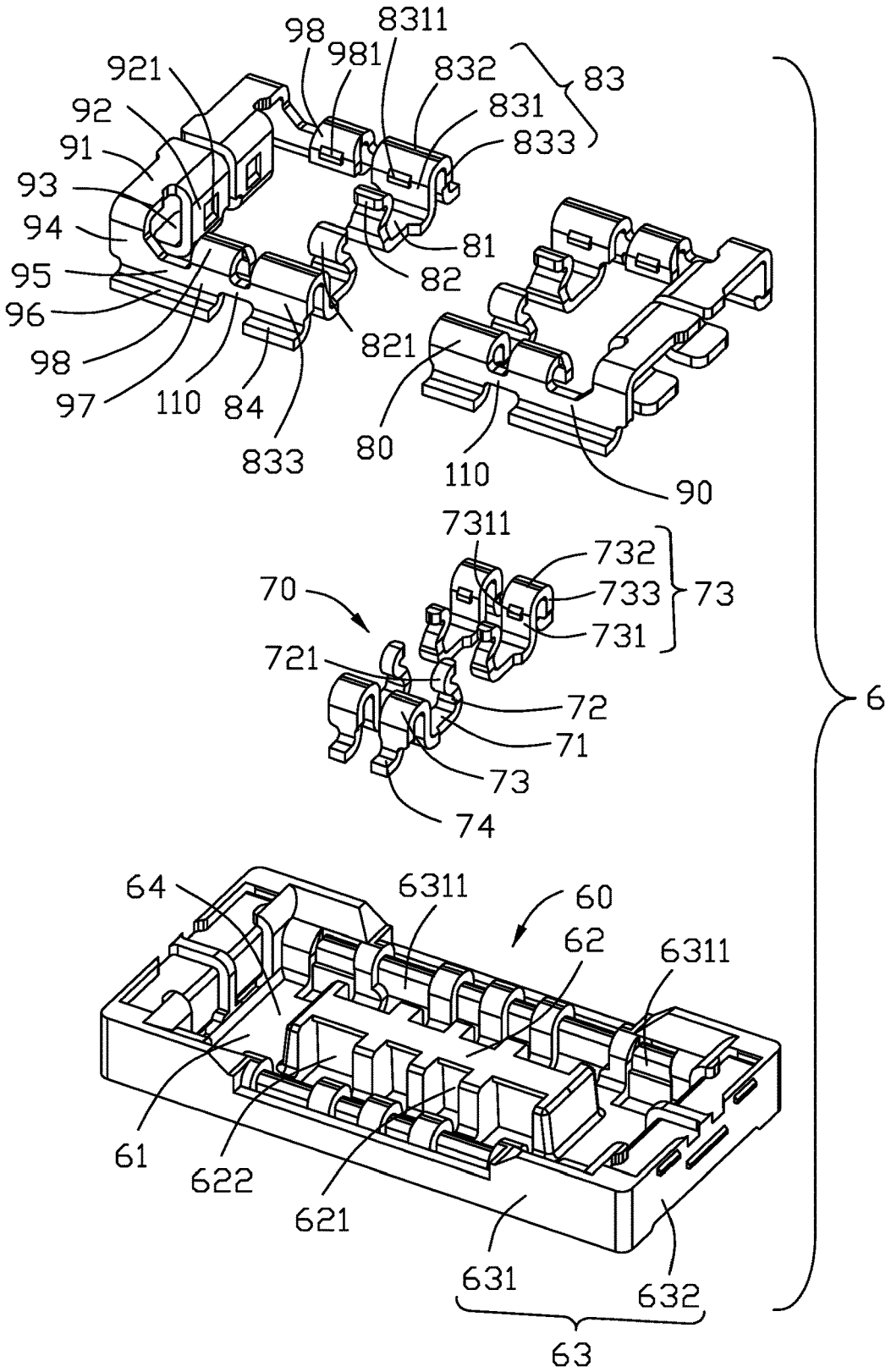
FIG. 7 is an exploded view of the receptacle connector.
Figure 8:
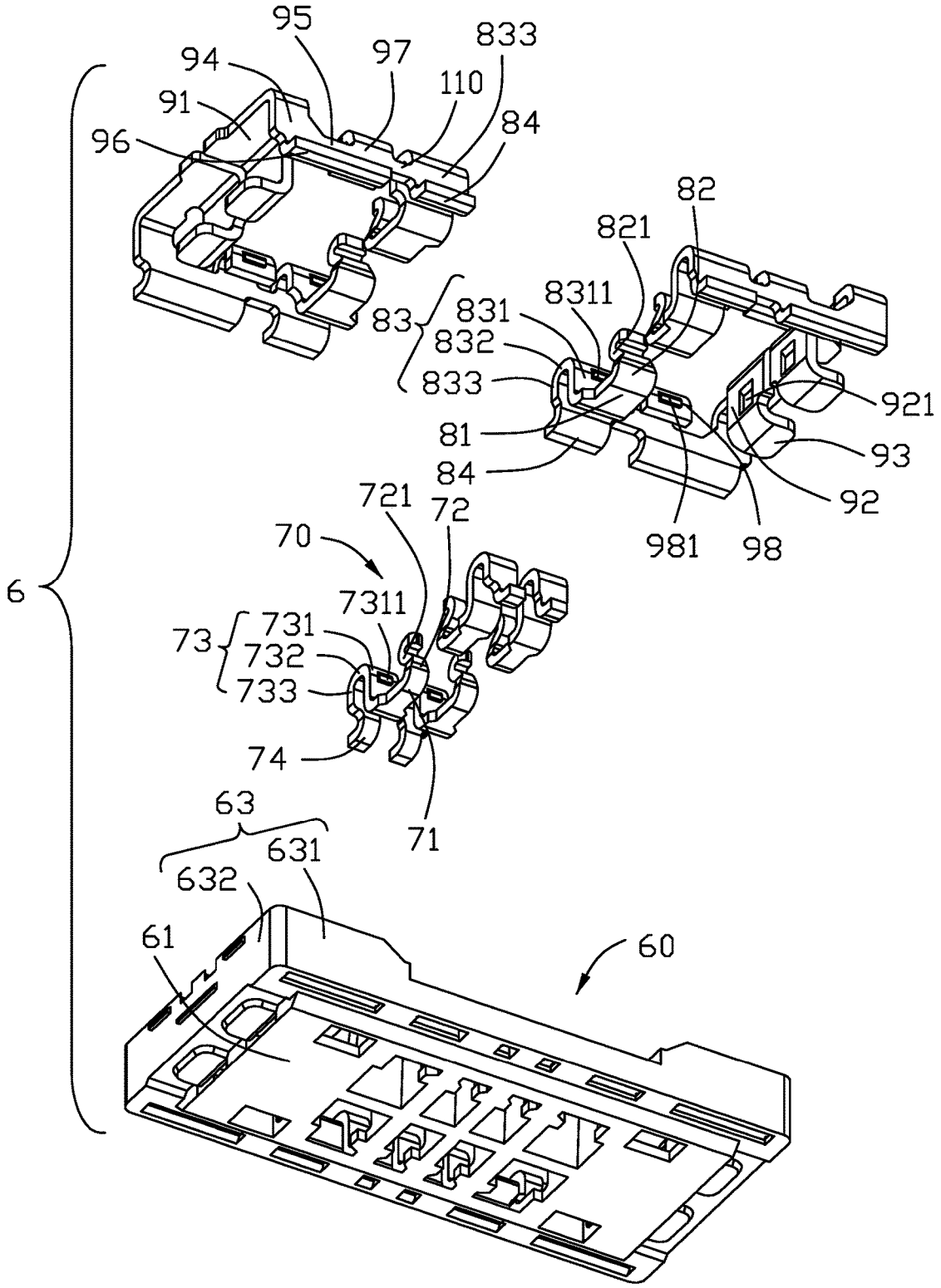
FIG. 8 is another exploded view of the receptacle connector.

Referring to FIGS. 1-4 and 7-8, the receptacle connector 6 includes an elongate insulative housing 60, a plurality of signal contacts 70 and a pair of power contacts 80 secured (e.g., insert molded) to the insulative housing, and a pair of holding members 90 secured to two opposite ends of the insulative housing, wherein the pair of holding members are connected to the pair of power contacts by a pair of connecting portions 110.

The insulative housing 60 has a bottom wall 61, an island 62, and a peripheral wall 63. The peripheral wall 63 has a pair of side walls 631 along a lengthwise direction and a pair of end walls 632 along a widthwise direction. The insulative housing 10 therefore defines a receiving space 64 surrounding the island 62. The island 62 has grooves 621 and 622. The side walls 631 have grooves 6311.

Each of the signal contacts 70 has a base 71, an arm 72, a generally U-shaped securing part 73, and a soldering part 74. The arm 72 is S-shaped and has a portion 721. The securing part 73 includes an inner portion 731, an outer portion 733, and an upper portion 732. The inner portion 731 has a protrusion 7311. The inner portion 731 is exposed to the receiving space 64.

Each of the pair of power contacts 80 is similarly structured as the sign contact 70 but has a larger width. Therefore, the power contact 80 has a horizontal base 81, resilient upwardly extending arm 82 linked to the horizontal base 81, a generally upside-down U-shaped securing part 83 linked to the horizontal base 81 opposite to the arm 82, and a horizontal soldering part 84 linked to the securing part 83, wherein the arm 82 is S-shaped and has a portion 821, the securing part 83 includes an inner portion 831, an outer portion 833, and an upper portion 832, and the inner portion 831 has a protrusion 8311. The inner portion 831 is exposed to the receiving space 64.

Each holding member 90 includes a pair of horizontal bases 91, a pair of vertical securing portions 92 connected respectively to the bases 91, a pair of horizontal fixing legs 93 connected respectively to the securing portions 92 and parallel to the bases 91, and a pair of joining portions 94 linked respectively to the bases 91, a pair of vertical outer portions 95 respectively linked to the corresponding joining portions 94, a pair of horizontal legs 96 respectively connected to the corresponding outer portions 95, a pair of vertical side portions 97 respectively connected to the corresponding outer portions 95, and a pair of vertical latching portions 98 respectively linked to the corresponding side portions for latching the mated plug connector 1. The latching portion 98 has a protrusion 981 thereon. In this embodiment, the vertical outer portions 95 and the corresponding vertical side portions 97 extend horizontally to form a pair of vertical side arms (not labeled) located by outer sides of the corresponding horizontal bases 91 and respectively secured to the corresponding side walls 631.

Each connecting portion 110 is integrally connected between the side portion 97 of the holding member 90 and the outer portion 833 of the power contact 80. In the embodiment shown each holding member 90 is made of two parts, though it may be a one-piece construction if desired and properly configured and dimensioned. Notably, in the embodiment each holding member 90 is required to be made of two parts because of existent lengths of the base 81 and the arm 82 of each power contact 80.

Figure 9:
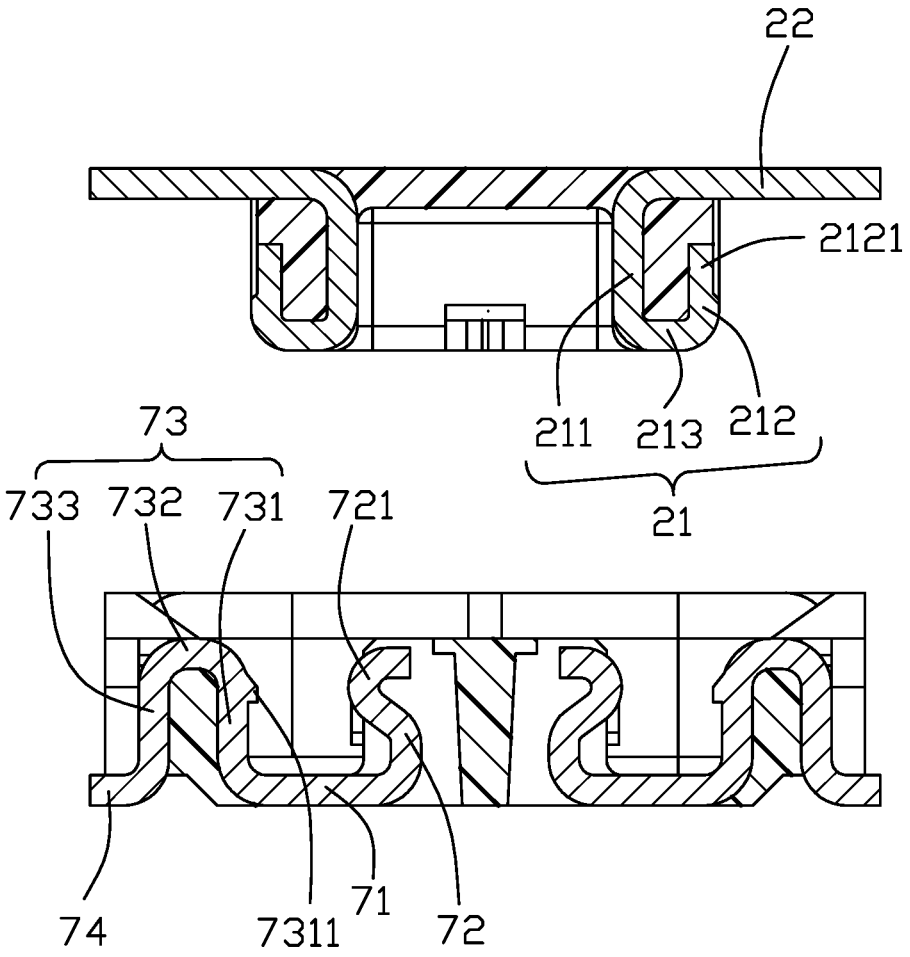
FIG. 9 is a cross-sectional view of the receptacle connector and the plug connector before assembling.
Figure 10:
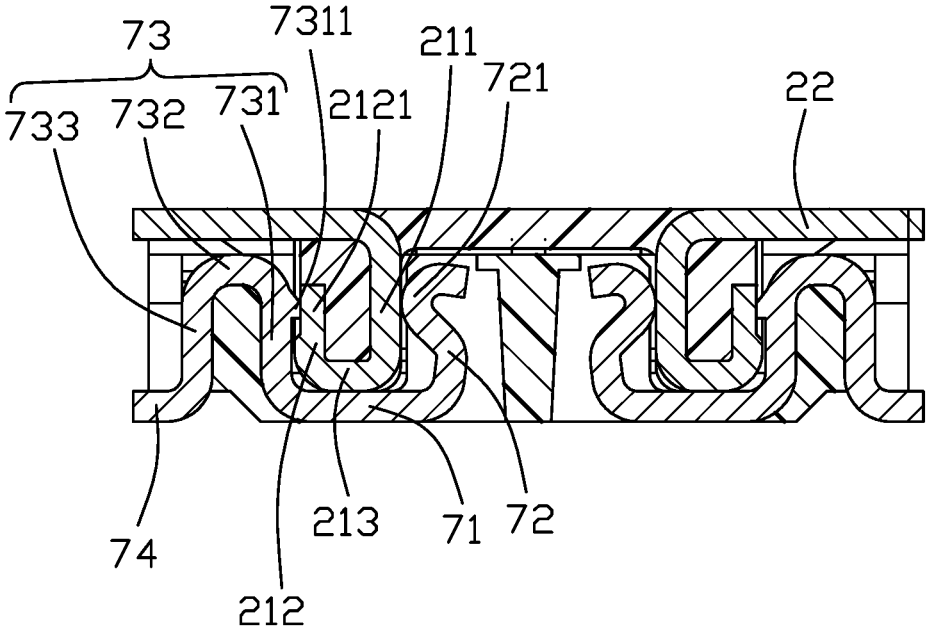
FIG. 10 is a cross-sectional view of the receptacle connector and the plug connector after assembling.
Figure 11:
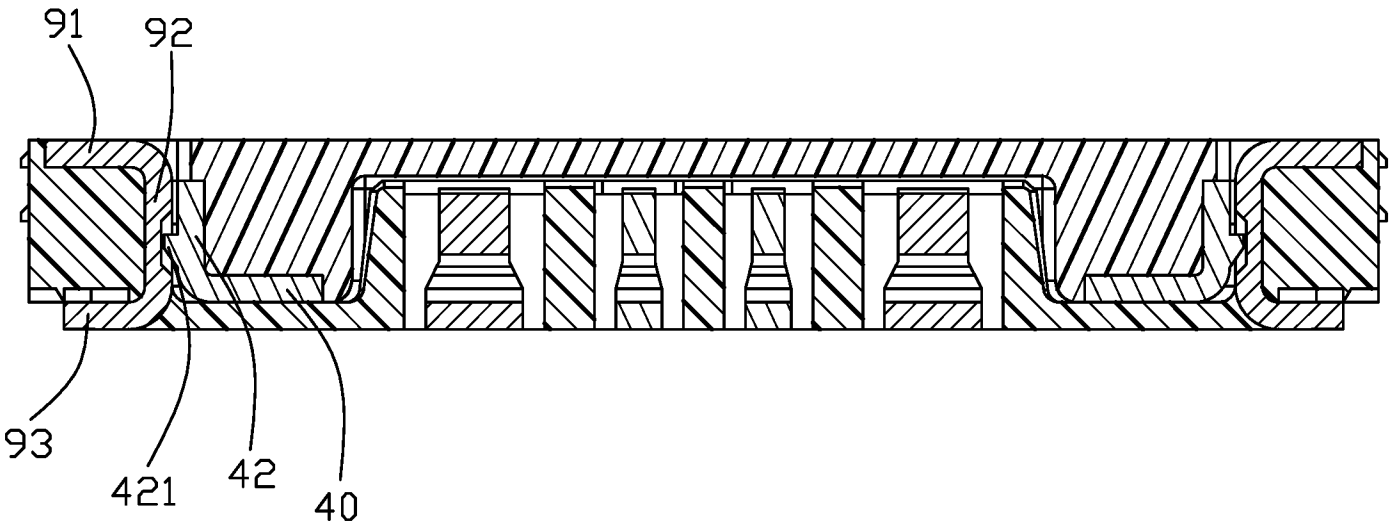
FIG. 11 is a cross-sectional view of the receptacle connector and the plug connector taken along a line passing through two holding members thereof.
Figure 12:
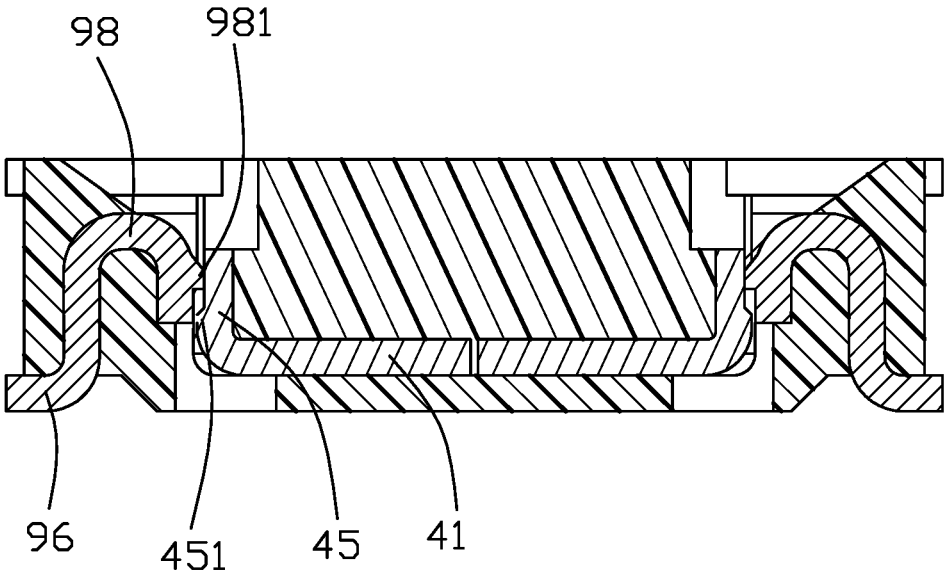
FIG. 12 is another cross-sectional view of the receptacle connector and the plug connector taken along another line passing through the two holding members.

Referring to FIGS. 1-4 and 9-12, the signal and power contacts 20 and 30 and the holding members 40 of the plug connector 1 are correspondingly engaged with the signal and power contacts 70 and 80 and the holding members 90 of the receptacle connector 6, respectively, in a generally known manner in this art.

With provision of the connecting portions 50 or 110 to integrally connect the holding member to adjacent power contacts, an interconnected structure to decrease temperature rise in conducting large current may be obtained.

What is claimed is:

1. An electrical receptacle connector for mating with a plug connector, comprising:

an insulative housing including a pair of side walls and a pair of end walls to commonly define a receiving space surrounding an island;

a plurality of signal contacts secured to the insulative housing and exposed to the receiving space;

a pair of holding members secured to two opposite ends of the insulative housing and exposed to the receiving space, each of said holding members having a pair of horizontal bases and a pair of vertical side arms located respectively by outer sides of the corresponding bases; and a plurality of power contacts secured to the insulative housing, exposed to the receiving space, and disposed adjacent to the pair of holding members, wherein the pair of holding members act as power contacts, and the pair of side arms of each of said holding members are integrally connected to adjacent ones of the power contacts and respectively secured to the pair of side walls; wherein each of the power contacts has a horizontal base and a resilient upwardly extending arm linked to the base and located in the island.

2. The electrical receptacle connector as claimed in claim 1, wherein the resilient upwardly extending arm is of an S-shaped configuration.

3. The electrical receptacle connector as claimed in claim 1, wherein each of the power contacts further includes an upside-down U-shaped securing part integrally secured to the housing.

4. The electrical receptacle connector as claimed in claim 3, wherein each of the power contacts further includes a horizontal soldering part linked to the securing part.

5. The electrical receptacle connector as claimed in claim 1, wherein each of the holding members further includes a pair of latching portions respectively linked to the corresponding pair of side arms and exposed to the receiving cavity for latching the plug connector.

6. The electrical receptacle connector as claimed in claim 5, wherein each of said holding members further includes a pair of horizontal legs linked to the corresponding pair of side arms opposite to the corresponding latching portions, respectively.

7. The electrical receptacle connector as claimed in claim 5, wherein each of the holding members is made by two parts, and the pair of side arms are unitarily formed with said two parts, respectively.

8. The electrical receptacle connector as claimed in claim 7, where each part of each of the holding members further includes a pair of vertical securing portions around the corresponding end wall.

9. The electrical receptacle connector as claimed in claim 1, wherein corresponding to each of the holding members of the electrical receptacle connector, the mated plug connector has another holding member having a pair of outer portions each with a step thereon, and a pair of another power contacts each connected with the corresponding outer portion via a connecting portion and having thereon another step which is continuously connected to the step.

10. The electrical receptacle connector as claimed in claim 9, wherein in the receptacle connector, each of the holding members further includes a pair of latching portions respectively linked to the corresponding pair of side arms and exposed to the receiving cavity for latching the step of the corresponding securing portion of the plug connector.

11. The electrical receptacle connector as claimed in claim 10, wherein the power contact of the receptacle connector is mated with another corresponding upside-down U-shaped power contact of the plug connector during mating.

12. An electrical receptacle connector for mating with a plug connector, comprising:

an insulative housing including a pair of side walls and a pair of end walls to commonly define a receiving space surrounding an island;

a plurality of signal contacts secured to the insulative housing and exposed to the receiving space;

a pair of holding members secured to two opposite ends of the insulative housing and exposed to the receiving space, each of said holding members having a pair of horizontal bases and a pair of vertical side arms respectively located by outer sides of the corresponding bases; and a plurality of power contacts secured to the corresponding side walls of the insulative housing, exposed to the receiving space, and disposed adjacent to and connected to the pair of holding members, wherein the pair of side arms of each holding member are unitarily connected respectively to the adjacent power contacts and respectively secured to the pair of side walls; wherein each of the side arms is equipped with a latching portion with a protrusion thereon for latching the plug connector, and the corresponding adjacent power contact is closely located beside said latching portion; wherein each of said power contacts further includes a resilient arm spaced from the corresponding side wall and disposed in the island.

13. The electrical receptacle connector as claimed in claim 12, wherein each of said power contacts includes an upside-down U-shaped securing part secured to the corresponding side wall and including another protrusion for latching the plug connector.

14. The electrical receptacle connector as claimed in claim 13, wherein each of said power contacts includes a horizontal base between the securing part and the resilient arm.

15. The electrical receptacle connector as claimed in claim 14, wherein each of said holding members further includes a pair of securing portions extending from the base thereof and located on the corresponding end wall, and a pair of fixing legs extending respectively from the corresponding securing portions toward the corresponding power contacts.

16. An electrical connector assembly comprising:

a receptacle connector and a plug connector adapted to be mated with each other, said receptacle connector including an insulative housing having a pair of side walls and a pair of end walls commonly defining a receiving space with an island therein;

a pair of holding members integrally secured around the pair of end walls, respectively, each of said holding members including a pair of bases on the end wall with a pair of side arms in the corresponding side walls, respectively;

two pairs of power contacts integrally secured to the corresponding side walls, respectively and unitarily connected to the corresponding holding members, respectively, each of said power contacts including a resilient arm transversely aligned with the island; and said plug connector including another insulative housing defining another receiving space for receiving said island, a pair of another holding members integrally secured to said another insulative housing, and a plurality of another power contacts integrally secured to said another insulative housing, transversely facing said another receiving space and unitarily connected to the corresponding another holding members, respectively; wherein during mating, the holding members of the receptacle connector are coupled with the corresponding another holding members of the plug connector, the island is received within said another receiving space, and the power contacts of the receptacle connector are mated with the corresponding another power contacts of the plug connector.

17. The electrical connector assembly as claimed in claim 16, wherein each of said another holding members of the plug connector includes a pair of securing portions and a pair of fixing legs downwardly extending from the corresponding securing portions, respectively, in a parallel relation.

18. The electrical connector assembly as claimed in claim 16, wherein each of said another power contacts of the plug connector includes a step, and each of said another securing portions includes another step continuously connected to said step of the corresponding power contact.

19. The electrical connector assembly as claimed in claim 18, wherein each of the holding members of the receptacle connector includes a latching portion located beside the corresponding power contact, and each of the power contacts of the receptacle connector has a protrusion adapted to be engaged with the step of the corresponding another power contact of the plug connector while each latching portion of the receptacle connector has another protrusion adapted to be engaged with said another step of each said another securing portion of the plug connector.

20. The electrical connector assembly as claimed in claim 19, wherein in each power contact of the receptacle connector, the protrusion is formed on an upside-down U-shaped securing part, and the base is linked between the resilient arm and the upside-down U-shaped securing part.

* * * * *